United States Patent [19]

Schoenberg

[11] Patent Number: 4,465,464

[45] Date of Patent: Aug. 14, 1984

[54] BALLISTIC MISSILE STRUCTURE SIMULATOR

[76] Inventor: George R. Schoenberg, 2698 Burnham, Royal Oak, Mich. 48073

[21] Appl. No.: 463,417

[22] Filed: Feb. 3, 1983

[51] Int. Cl.[3] ..... F41F 27/00; G09B 9/00

[52] U.S. Cl. ..... 434/12

[58] Field of Search ..... 434/11, 12, 13

[56] References Cited

U.S. PATENT DOCUMENTS

| | | | |
|---|---|---|---|
| 2,351,891 | 6/1944 | Weisbaum | 434/11 X |
| 3,075,301 | 1/1963 | Fiedler et al. | 434/13 |
| 3,075,302 | 1/1963 | Fiedler et al. | 434/13 |
| 3,120,709 | 2/1964 | Madden | 434/12 |

*Primary Examiner*—William H. Grieb

*Attorney, Agent, or Firm*—Peter A. Taucher; John E. McRae; Robert P. Gibson

[57] ABSTRACT

It is proposed to construct a low cost simulated ballistic missile for training purposes or as a military decoy. The invention contemplates the use of standard I-beams, reinforced pipe, and cement filler to provided missile stages that duplicate the weight and overall dimensions of the actual missile stages. The beams are welded into a columnar cross-sectional shape sized to fit into the reinforced pipe. Principal advantage of the invention is the achievement of a structurally strong simulated missile at relatively low manufacturing cost.

8 Claims, 6 Drawing Figures

BALLISTIC MISSILE STRUCTURE SIMULATOR

GOVERNMENT INTEREST

The invention described herein may be manufactured, used, and licensed by or for Government for governmental purposes without payment to me of any royalty thereon.

BACKGROUND AND SUMMARY OF THE INVENTION

This invention relates to a simulated missile usable for training purposes, e.g., to test vehicle capabilities for lifting, loading, and transporting missiles, and also for training troops in simulated battle, where a simulated missile is transported by trailer, removed from the trailer, and the missile stages assembled or erected in the field. The simulated missile could also be used as a decoy for deceiving a potential enemy force engaged in aerial reconnaissance. The general concept of decoy military equipment is already known; see for example a newspaper article in the PARADE section of the Detroit Free Press on June 6, 1982 illustrating a dummy decoy tank used by Allied forces in World War II.

The basic concept of the present invention involves the use of conventional structural steel, reinforced cement pipe and cement filler to provide a structure that simulates actual missile shape and weight distribution while duplicating overall weight and center of gravity for each individual missile stage. One representative missile comprises three stages connectable together at the launch site to provide the complet missile; my invention seeks to form a dummy or simulated missile structure for each stage, using low cost, readily available materials. In a typical situation two of the stages would be cylindrical; a third stage would be axially convergent, i.e., conical or ogival in shape. The invention will probably find greatest usage in simulating medium size, multi-stage missiles, such as Patriot, Pershing or Cruise missiles.

In constructing the cylindrical missile stages the present invention uses commercial I-beams of the length of the simulated missile stage, welded together into a triangular configuration and then inserted into a cylindrical pipe or skin. The I-beam dimensions (commercially available) will be determined by the missile diameter to be simulated and the skin wall thickness intended to surround the beams. The weight simulation is achieved by filling the cavity or cavities defined by the I-beam structure and skin with the appropriate amount of cement. The amount of cement will be determined by the additional weight required above beam and skin weight, divided into the specific gravity of the cement used. End stops or bulkheads are positioned in each simulated missile stage to determine the cubic measures of cement and to create the desired center of gravity specified for the associated missile stage. Recommended skin which would most inexpensively provide integral structure strength is commercial reinforced cement sewer pipe. If a decoy function is required for missile simulation to defeat electronic surveillance by aircraft, a plastic skin, with appropriate coloring, fins, protrusions and markings, could be attached to furring strips around outer surfaces of the pipes.

A feature of my invention involves the minimizing of missile stage cost while providing a structurally strong construction resistant to breaking forces, e.g. in the shear direction. My use of a triangular reinforcement structure and cement filler causes external impact forces (due to possible falling of the missile stage or impact at a local edge area) to be resisted by transforming shear forces into compressive forces. By analogy to the gothic arch concept, the impact forces are distributed along the three interfaces of the three structural support beams constituting the internal triangular reinforcement structure. The cement filler is also helpful in absorbing point impact forces, particularly when the cement is utilized between the outer surfaces of the triangular reinforcement structure and the inner surface of the pipe.

In constructing the axially convergent missile stage the invention preferably utilizes an axial rod or shaft as a mounting device for annular counterweight(s). The counterweight(s) is/are adjusted along the shaft to a position wherein the weight distribution of the simulated missile stage is the same as that of the actual missile stage being simulated.

THE DRAWINGS

Figures 1, 2, 3, 4, 5, 6:
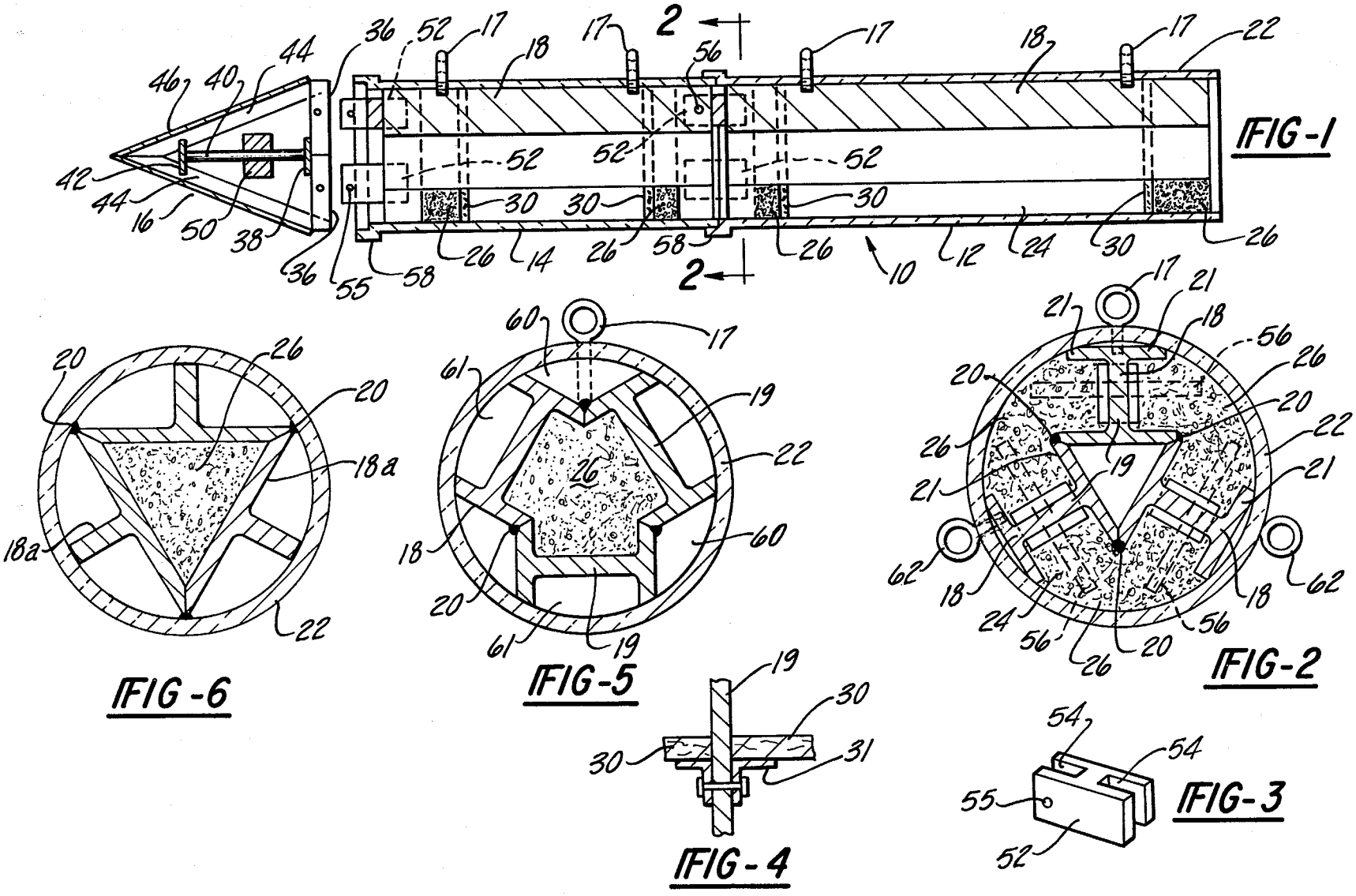
FIG. 1 is a longitudinal sectional view taken through a simulated missile constructed according to my invention.
FIG. 2 is an enlarged transverse sectional view taken on line 2—2 in FIG. 1.
FIG. 3 is a perspective view of a connector bracket usable in the FIG. 1 assembly.
FIG. 4 illustrates a structural detail used in the FIG. 1 assembly for retaining bulkheads employed to determine the quantity of cement in a missile stage.
FIGS. 5 and 6 are views similar to FIG. 2 but illustrating other forms of the invention wherein the cement filler occupies the central cavity formed by the triangular reinforcement structure.

Attached to FIG. 1 shows a representative simulated missile 10 embodying my invention. The simulated missile includes a cylindrical rear stage 12, a cylindrical intermediate stage 14, and a convergent conical nose stage 16, formed as three separable sections. Stages 12 and 14 are shown in their connected conditions; stage 16 is shown separated from the other two stages. Each stage 12 or 14 is provided with two removable lifting eyes 17.

The term "missile stage" refers generally to an elongated structure containing either a fuel-propulsion assembly or a warhead. In the illustrated arrangement the real warhead would be contained in convergent stage 16; each of the other two stages would contain a fuel-propulsion system. Typically the rear stage 12 would be the longest, about twelve feet in one case; stage 16 would be the shortest, for example about five feet in length. Typical weights would be about 10,000 pounds for real stage 12, about 6000 pounds for real stage 14, and seven hundred pounds for stage 16. Some missiles contain four stages rather than three. The assembly shown in FIG. 1 is not a real missile; it does not contain a propulsion system, a fuel supply system, a warhead, or flight controls. The FIG. 1 assembly simulates or duplicates the overall dimensions, weights and weight distribution (center of gravity) of an actual missile. The three stages are formed separately and are capable of being handled individually. They may be connected together to form a complete simulated missile assembly.

Stages 12 and 14 are generally similar except for weight and length. FIG. 2 is a transverse sectional view taken through stage 12 or 14, showing three similar I-beams 18 welded together at 20 and disposed within a cylindrical cement pipe 22. The pipe in a given stage 12 or 14 may be a single pipe (as shown in FIG. 1) or a plurality of pipes combined together, e.g. an eight foot pipe section combined with a four foot pipe section. Lifting eyes 17 are suitably affixed to selected ones of the I-beams at appropriate positions along the length of the missile stage. Each I-beam 18 includes a web wall 19 and end flanges 21. Cement filler 26 is poured into otherwise void segmental spaces formed between adjacent ones of beams 18. In a representative missile stage twelve feet long only a few linear feet of the pipe might be occupied by cement filler 26; the cement quantity is determined by such factors as cross-sectional area chosen for receiving cement and the cement density selected. The cement filler can be near the longitudinal center of pipe 22, or adjacent its ends, or optimally distributed along the pipe length, depending on desired center of gravity and density of the cement filler. The cement filler should be distributed symmetrically relative to the pipe axis. Cement density can be varied according to the relative quantity and particle size of the gravel or other filler material selected. It is believed that cement density could be reduced, if desired, by the use of various light weight filler materials, alone or in combination with gravel, e.g. expanded styrofoam beads or spheres pre-encapsulated with water-resistant coatings. Use of low density cement may be a desirable expedient for increasing the length of pipe 22 having the cement filler, to reduce stress points, and to minimize and simplify the retaining bulkhead mechanism 30 used to retain the cement while it is hardening. The length of pipe containing the cement is affected also by the beam 18 cross sectional dimensions, and resultant space availabe to receive the cement.

As shown in FIG. 1, the three I-beams 18 are substantially co-extensive in length with the surrounding pipe 22. In this particular embodiment of the invention the cement filler 26 occupies separate discrete areas or zones near the ends of pipe 22. The central area along the length of pipe 22 is devoid of cement filler. In some situations the entire length of the pipe could be filled with cement. Prior to insertion of the beam 18 assembly into pipe 22 the beam assembly may be provided with transverse partitions or bulkheads 30 at predetermined points along its length. FIG. 4 fragmentarily shows angle iron bracket means 31 for attaching a plywood partition 30 to the web wall 19 of beam 18.

In the arrangement of FIGS. 1 and 2 each transverse partition 30 comprises three separate partition elements of generally segmental shape. The inner edge of each partition element conforms to the contour of the beam surfaces. The outer edge of each partition conforms to the contour of the pipe 22 interior surface. The partitions serve as cement-containment forms. The shape of each partition is dictated by the cross-sectional shape of each beam 18 and beam 18 arrangement FIGS. 2, 5 and 6 show three alternate beam arrangements requiring differently configured partition 30 shapes.

In FIG. 2 the cement filler is shown as occupying the peripheral zones between the pipe inner surface and beam outer surfaces; however the cement filler could be disposed in the central triangular space on the pipe axis. In FIG. 5 the cement filler 26 is shown as occupying the central space encompassed by the three I-beams; alternately or additionally the cement filler could occupy either the three peripheral spaces 60 and/or the three peripheral spaces 61. FIG. 6 uses T-shaped beams 18 a welded into the desired triangular configuration. The cement filler 26 is shown occupying the central space encompassed by the T-shaped beams; however the cement filler could be disposed in selected ones of the peripheral spaces between the beam assembly and the pipe inner surface. In any case the cement filler should be distributed symmetrically in radial directions measured from the pipe axis.

The relative quantities of cement filler 26 in different areas along pipe 22 are predetermined in accordance with the desired location of the missile stage center of gravity along the stage length. Center of gravity location is made to correspond with the center of gravity location in the real missile. The total quantity of cement filler 26 is determined by the total weight of the actual missile stage being simulated. Thus, the weight of cement fillers 26 is added to the weight of lifting eyes 17, beams 18 and pipe 22 to provide the total stage weight.

Each of stages 12 and 14 is formed separately with the same components and procedures, except that weight and length of each stage are different for the respective stages. The nose stage 16 is differently configured so that a different fabrication procedure is involved. Nose stage 16 comprises three radial plates 36 welded to a central plate 38. A rod or shaft 40 extends axially from plate 38 to a second smaller plate or bulkhead 42 having slot-type connections with three convergent structural elements 44. Elements 44 have their rear ends welded to the outer ends of plates 36. A thin metal or plastic skin 46 is glued, bonded, or otherwise secured to the outer surfaces of structural elements 44 to give an ogival contour to nose stage 16. If an actual nose cone is available it may be adapted and used instead of the simulated nose stage shown in FIG. 1. The illustrated device represents a low cost simulation.

To duplicate the weight of an actual missile nose stage it is necessary to add additional mass to the assembly. As shown in FIG. 1, this additional weight is provided by an annular counterweight 50 encircling shaft 40. Suitably sleeves, pins, plates, etc. (not shown) may be welded or otherwise attached to shaft 40 to firmly retain counterweight 50 in a desired fixed location on shaft 40. The location of weight 50 is preselected so that the center of gravity of nose stage 16 is the same as the center of gravity of the real missile stage being simulated.

Missile stages 12, 14, and 16 are separately formed. However each stage preferably has means at one or both of its ends for connecting that stage to an adjacent stage to form a complete missile assembly. Various types of connector devices can be utilized, including the latch structures used on the real missile, or solenoid-operated latches or manual latches. The connector devices should be of sufficient strength to prevent buckling or bending of the connectors or adjacent wall structures when the multi-ton missile assembly is being moved or elevated by the cranes or launch equipment during training exercises. FIGS. 1, 2, and 3 illustrate suggested low cost manually-operated latch or connector devices that can be employed between the missile stages. Each connector system comprises three generally H-shaped blocks 52, each having oppositely-directed slots 54 adapted to fit onto the confronting edges of the beam 18 web walls 19 and/or walls 36. Each block 52 is permanently attached at one end to a beam wall 19, as by welding, riveting, press-fit, bonding, etc. The other slotted end of each block 52 fits over the confronting edge of an aligned beam wall 19 or plate 36. Holes 55 may be provided in blocks 52 to receive latch rods 56 insertably through openings in the wall of pipe 22. Alignment of the various connector blocks 52 with the edges of beam walls 19 or plates 36 on adjacent missile stages may be facilitated by the use of printed arrows or lines on external surfaces of the missile stages. The connector-latch system is intended primarily to prevent axial displacement of one missile stage from the adjacent stage. Resistance to buckling or radial dislocation is provided by an annular lip 58 formed on an end of each pipe 22.

The cross-sectional configuration of each internal beam assembly can be varied, providing the beams are made to effectively contact the interior surfaces of pipe 22, and the beam assembly is sufficiently symmetrical to maintain balanced weight distribution in the circumferential direction. In the FIG. 2 assembly each of the three beams 18 has the same cross section and hence same weight. The beams are arranged symmetrically with outer edge areas thereof engaging the pipe interior surface. Cement filler 26 is poured into each segmental space 24 to approximately the same axial depth.

FIG. 5 illustrates a beam configuration that can be employed in lieu of the configuration shown in FIG. 2. In both cases each beam has an H-shaped cross section; in each case the outer edges of the beams engage the pipe interior surface to provide columanr reinforcement. In the FIG. 2 arrangement the beams 18 are arranged so that web walls 19 thereof extend along radial lines originating at the pipe center; the three innermost flange walls of the beams have their edges welded together so that the flanges form an equilateral triangle. In the FIG. 5 arrangement the beams are arranged with their web walls 19 extending along chordal lines of the pipe circle; each beam has its flange walls located so that one edge of each flange wall contacts the pipe interior surface and the other edge of each flange wall contacts and edge of an adjacent flange. The beams are welded into a high strength columnar reinforcing unit. In the FIG. 5 arrangement cement filler 26 is poured into the central space encompassed by the three beams. If desired, the cement should be located in segmental spaces 60 and/or 61. The cement zones are intended to be symmetrical around the missile's longitudinal axis.

FIG. 6 illustrates a third configurational possibility that utilizes T-shaped beams rather than the H configuration shown in FIGS. 2 and 5. Whatever the beam configuration, the beams are welded together to form a beam assembly prior to insertion of the beam assembly into the associated pipe 22.

The method of attaching lifting eyes 17 to the missile stage is somewhat dependent on the type of beam construction used. In the FIG. 2 arrangement the lifting eyes are screwed into threaded openings in beams 18. When the missile is being transported on a trailer, railroad car, etc. it is preferably chained or strapped down onto the bed of the vehicle. For this purpose tie-down eyes 62 may be provided at two or more points along the length of each missile stage, as shown generally in FIG. 2. Each tie-down eye may be threaded into a threaded opening in an I-beam.

Pipe 22 for missile stages 12 and 14 may be commercially available sewer pipe assembled from standard lengths or custom ordered; each pipe has internal wire mesh or crossed rod reinforcement. A particular aim of the invention is to provide a simulated missile out of commercially available components and materials, with minimum fabrication equipment expense.

As previously noted, the simulated missile can be constructed to different sizes, weights, and stages in accordance with the actual missile intended to be simulated. Representative magnitudes of the components for a Pershing Missile are shown herebelow.

Illustrative Requirements, Specifications and Costs

| | Weight | Length | Diameter |
|---|---|---|---|
| Stage 12 | 9147 lb. | 144 inch | 40 inch |
| Stage 14 | 5819 lb. | 100 inch | 40 inch |
| Stage 16 | 676 lb. | 62 inch | 32 inch cone average |

Suggested Performance

| | | Weight-lb. | Cost $ |
|---|---|---|---|
| Stage 12 | Sewer pipe (30" I.D.) 383 lb./ft. | 4596 | 462.24 |
| | I-beams (3) 252 lb./ft. | 3024 | 969.94 |
| | Hooks | 20 | |
| | Portland Cement 148 lb./ft.$^3$ | 1507 | 7.00 |
| | TOTAL | 9147 | $1,439.18 |

Cross sectional area within pipe=4.91 ft.$^2$

Free space 26 (approx. 50% of total A)=2.45 ft.$^2$

Each linear ft. of pipe represents 2.45 ft.$^3$ free space.

For Cement @150 (lb./ft.)$^3$ each ft. of pipe carries approximately 367 lb. cement.

To provide 1507 lb. cement requires a fill of about 4.1 linear feet. Remainder is vacant. Relative quantities of cement in each end of the pipe determine center of gravity for the missile stage. Cement of a lower density can be used if it is desired to have a greater cement fill in the pipe.

Stage 14

Use same type calculations as described for stage I.

Stage 16

Adjust the stage weight by selecting the framework component sizes. Final weight is achieved by correct sizing of counterweights 50.

The principal advantage of this simulated missile design is that is uses relatively low cost shelf items; i.e., sewer pipe, standard I-beams and cement, to achieve a relatively strong rugged structure wherein the components mutually reinforce one another. The I-beams are welded into a strong columnar design that reinforces the sewer pipe along its entire length. Center of gravity of each missile stage can be predetermined by choosing the pipe area to be filled with cement.

I wish it to be understood that I do not desire to be limited to the exact details of construction shown and described for obvious modifications will occur to a person skilled in the art.

I claim:

1. A simulated missile comprising a plurality of separately-formed elongated missile stages adapted to be connected together in end-to-end relation to form a complete simulated missile; two of said missile stages being cylindrical, and a third missile stage being axially convergent; each cylindrical stage comprising a cylindrical pipe defining the stage outer contour, three structural beams of similar cross-section arranged symmetrically within the pipe, with edge areas thereof engaging the pipe interior surface, and cement filler occupying selected sections of the pipe interior length; the quantity of cement being sufficient to cause the respective cylindrical stage to have approximately the same total weight as the missile stage being simulated; the location of the cement being selected to cause the center of gravity of the stage to approximately coincide with that of the missile stage being simulated.

2. The simulated missile of claim 1: each beam having an H cross section.

3. The simulated missile of claim 2: each beam having arranged with its web wall extending along a radial line originating at the pipe center; the three innermost flange walls of the beams being interconnected at their edges to form an equilateral triangle; the three outermost flange walls of the beams being engaged with the pipe interior surface.

4. The simulated missile of claim 2; each beam being arranged with its web wall extending along a chord line of the pipe circle; each beam having its flange walls arranged so that one edge of each flange wall contacts the pipe interior surfae and the outer edge of each flange wall contacts an edge of another flange wall.

5. The simulated missile of claim 1: each beam having an H cross section; each beam having arranged with its web wall extending along a radial line measured from the pipe axis; each beam having two edges thereof welded to edge areas of the two other beams to form a relatively stiff three-dimensional reinforcement for the surrounding pipe.

6. The simulated missile of claim 1 wherein convergent missile stage comprises a shaft extending on the stage axis, and an annular counterweight encircling said shaft within the stage contour; said counterweight being sufficient to cause the convergent missile stage to have approximately the same total weight as the missile stage being simulated; the location of the counterweight being selected to cause the center of gravity of the convergent missile stage to approximately coincide with that of the missile stage being simulated.

7. The simulated missile of claim 1: the two cylindrical missile stages being arranged with their beams in confronting end-to-end alignment; and connector brackets having oppositely-directed slots fitting onto the confronting edges of the aligned beams.

8. The simulated missile of claim 1: the pipe in each cylindrical stage being a cement pipe having internal wire reinforcement; each pipe having a circumferential lip at one of its ends for fitting onto an end of the adjacent missile stage.

* * * * *